US012349767B2

(12) United States Patent
Tateno et al.

(10) Patent No.: US 12,349,767 B2
(45) Date of Patent: Jul. 8, 2025

(54) SOLE AND SHOE

(71) Applicant: ASICS CORPORATION, Kobe (JP)

(72) Inventors: Kenta Tateno, Kobe (JP); Masanori Sakaguchi, Kobe (JP); Hiroaki Nishimura, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/241,795

(22) Filed: Sep. 1, 2023

(65) Prior Publication Data

US 2024/0074530 A1 Mar. 7, 2024

(30) Foreign Application Priority Data

Sep. 5, 2022 (JP) ..... 2022-140847

(51) Int. Cl.

| | |
|---|---|
| ***A43B 7/14*** | (2022.01) |
| ***A43B 7/1425*** | (2022.01) |
| ***A43B 7/143*** | (2022.01) |
| ***A43B 7/1435*** | (2022.01) |
| ***A43B 7/144*** | (2022.01) |
| ***A43B 7/145*** | (2022.01) |
| ***A43B 13/18*** | (2006.01) |

(52) U.S. Cl.

CPC ..... *A43B 7/143* (2013.01); *A43B 7/14* (2013.01); *A43B 7/1425* (2013.01); *A43B 7/1435* (2013.01); *A43B 7/144* (2013.01); *A43B 7/145* (2013.01); *A43B 13/186* (2013.01)

(58) Field of Classification Search

CPC ..... A43B 7/14; A43B 7/1425; A43B 7/145; A43B 13/16; A43B 13/186

USPC ..... 36/25 R, 31

See application file for complete search history.

(56) References Cited

U.S. PATENT DOCUMENTS 1,550,715 A * 8/1925 Stout ..... A43B 7/22 36/176

4,638,576 A * 1/1987 Parracho ..... A43B 17/16 36/68

(Continued)

FOREIGN PATENT DOCUMENTS

EP 3892147 A1 10/2021

EP 4108120 A1 12/2022

(Continued)

OTHER PUBLICATIONS

European Search Report for EP Application No. 23194377.0, dated Nov. 6, 2023, 8 pp.

*Primary Examiner* — Marie D Bays

(74) *Attorney, Agent, or Firm* — KONRAD, RAYNES, DAVDA & VICTOR LLP; Alan S. Raynes

(57) ABSTRACT

A sole includes a midsole. The midsole includes: a first support portion that is configured to support a front portion of an MP joint of a wearer's foot; and a second support portion that is configured to support a rear portion of the MP joint of the wearer's foot, the second support portion having a shape extending rearward from the first support portion in a foot length direction. The first support portion has an elastic modulus lower than an elastic modulus of the second support portion. The midsole includes a thenar region surrounded by a first portion, a second portion, a third portion, and a fourth portion. A boundary portion between the first support portion and the second support portion passes through the thenar region.

19 Claims, 11 Drawing Sheets

(56) References Cited

U.S. PATENT DOCUMENTS 4,731,939 A * 3/1988 Parracho ..... A43B 17/16 36/31
2005/0086838 A1* 4/2005 Khantzis ..... A43B 1/0045 36/25 R
2005/0268492 A1* 12/2005 Fuerst ..... B29D 35/142 36/77 R
2006/0185197 A1* 8/2006 Rhenter ..... A43B 13/12 36/43
2010/0299969 A1* 12/2010 Paez ..... A43B 13/16 36/43
2012/0055041 A1* 3/2012 Mackey ..... A43B 7/1445 36/28
2013/0081305 A1* 4/2013 Byrne ..... A43B 13/181 36/31
2014/0290096 A1* 10/2014 Wilson, III ..... C09J 5/02 428/476.3
2014/0290097 A1* 10/2014 Bann ..... A43B 13/04 36/102
2014/0298680 A1* 10/2014 Oloff ..... A43B 7/1435 36/43
2015/0282561 A1* 10/2015 Swager Van Dok .. A43B 7/143 36/31
2016/0081426 A1* 3/2016 Olivieri ..... A43B 13/125 36/28
2016/0316853 A1 11/2016 Iuchi et al.
2016/0353838 A1 12/2016 Takeshita et al.
2017/0095033 A1* 4/2017 Farina ..... A43B 13/186
2018/0271211 A1* 9/2018 Perrault ..... A43B 13/181
2018/0271213 A1* 9/2018 Perrault ..... A43B 13/141
2019/0365048 A1* 12/2019 Fontaine ..... A43B 23/088
2020/0022452 A1* 1/2020 Hatano ..... A43B 13/181
2021/0267306 A1 9/2021 Sakaguchi et al.
2022/0104581 A1* 4/2022 Sakaguchi ..... A43B 13/141
2022/0378145 A1* 12/2022 Tateno ..... A43B 13/125
2023/0309649 A1* 10/2023 Rathod ..... A43B 3/128 36/28
2024/0041158 A1* 2/2024 Otake ..... A43B 5/06
2024/0341405 A1* 10/2024 Masumoto ..... A43B 7/145

FOREIGN PATENT DOCUMENTS

WO 2020136916 A1 7/2020
WO 2021210045 A1 10/2021

* cited by examiner

SOLE AND SHOE

CROSS REFERENCE TO RELATED APPLICATIONS

This nonprovisional application is based on Japanese Patent Application No. 2022-140847 filed on Sep. 5, 2022 with the Japan Patent Office, the entire contents of which are hereby incorporated by reference.

BACKGROUND

Field of the Disclosure

The present disclosure relates to a sole and a shoe.

Description of the Background Art

Shoes worn in sports and the like are utilized to reduce fatigue of the feet during running and exercising. For example, WO 2020/136916 A discloses a shoe capable of reducing a burden on an ankle joint. The sole of the shoe includes a rear bottom surface portion that, when placed on the flat virtual plane, comes into contact with the virtual plane, a toe portion having a height from the virtual plane that is greater than or equal to 170% and less than or equal to 250% with respect to a thickness dimension in the rear bottom surface portion, and a front bottom surface portion that is continuous with a front portion of the rear bottom surface portion, extends to the toe portion in a curved manner, and is separated from the virtual plane.

SUMMARY

In the shoe described in WO 2020/136916 A, it is desirable to further reduce the burden on the foot by suppressing the movement of the ankle joint from the time of landing to the time of taking off.

An object of the present disclosure is to provide a sole and a shoe capable of reducing a change in angle of an ankle joint from landing to taking off.

A sole according to one aspect of the present disclosure constitutes a part of a shoe, and includes: a midsole including an upper connection surface to which an upper is connected and that is configured to support a wearer's foot, wherein the midsole includes: a first support portion that is configured to support a front portion of an MP joint of the wearer's foot; and a second support portion that is configured to support a rear portion of the MP joint of the wearer's foot, the second support portion having a shape extending rearward from the first support portion in a foot length direction of the sole, the first support portion has an elastic modulus lower than an elastic modulus of the second support portion, the midsole includes a thenar region surrounded by a first portion, a second portion, a third portion, and a fourth portion, the first portion being located on a shoe center and located at a position rearward from a front end portion of the midsole in the foot length direction by a length of 15% of a total length of the upper connection surface; the second portion being located on the shoe center and located at a position rearward from the front end portion in the foot length direction by a length of 35% of a total length of the upper connection surface; the third portion corresponding to an intersection of a straight line that is orthogonal to the shoe center and passes through the first portion and an end portion on an inner foot side of the midsole in a foot width direction of the sole; and the fourth portion corresponding to an intersection of a straight line that is orthogonal to the shoe center and passes through the second portion and an end portion on an inner foot side of the midsole in the foot width direction, and a boundary portion between the first support portion and the second support portion passes through the thenar region.

Further, a shoe according to one aspect of the present disclosure includes: the sole; and the upper connected to the sole and providing, together with the sole, an accommodation space for the wearer's foot.

The foregoing and other objects, features, aspects and advantages of the present disclosure will become more apparent from the following detailed description of the present disclosure when taken in conjunction with the accompanying drawings.

DETAILED DESCRIPTION

Figure 1:
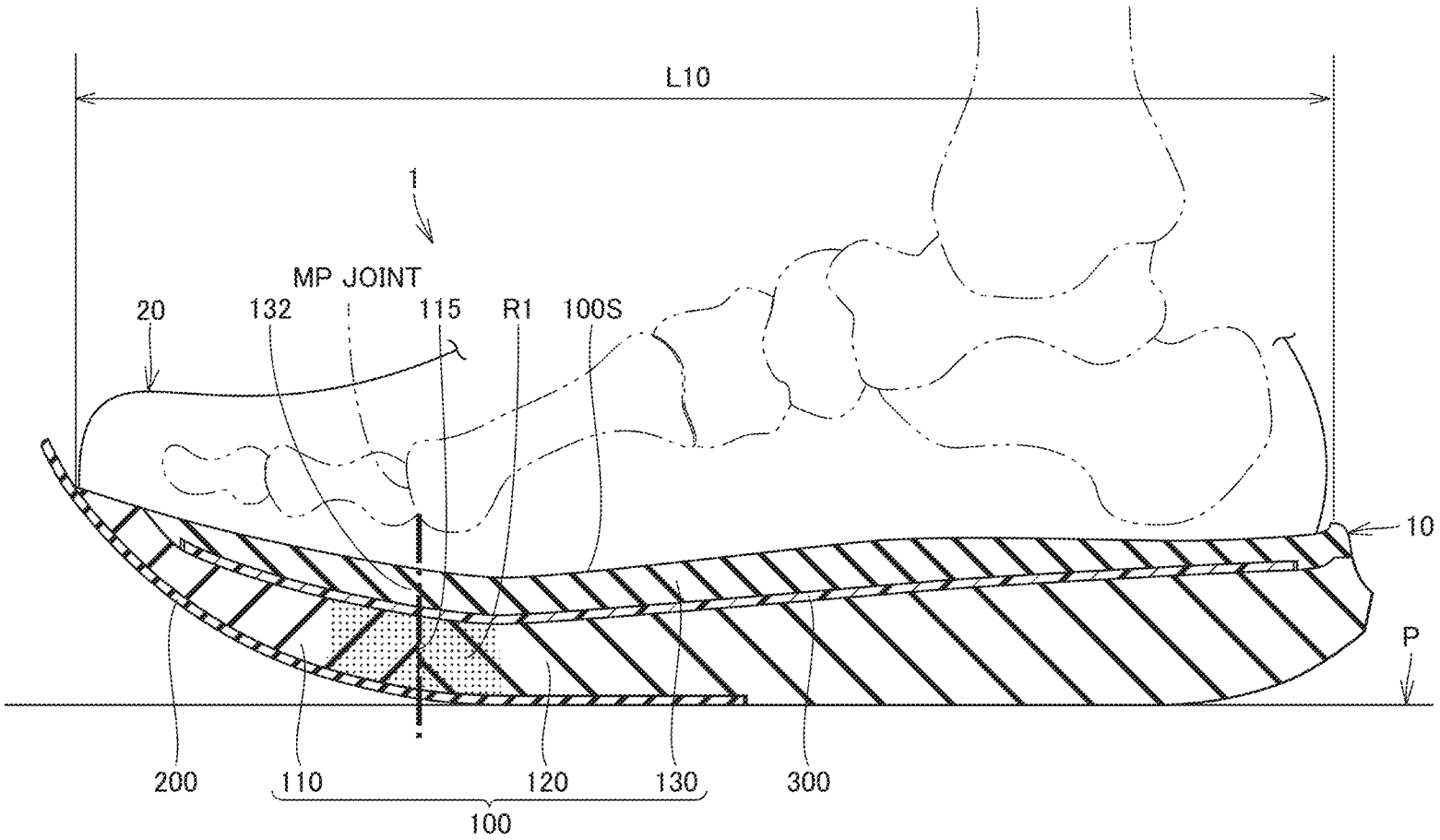
FIG. 1 is a cross-sectional view schematically illustrating a shoe in one embodiment of the present disclosure.

Embodiments of the present disclosure will be described with reference to the drawings. In the drawings hereinafter referred to, the same or corresponding members are denoted by the same reference numerals. In the following description, terms such as a foot length direction, a foot width direction, a front side, and a rear side are used. Terms indicating these directions indicate directions as viewed from a viewpoint of a wearer wearing a shoe 1 placed on a flat surface P (see FIG. 1) such as the ground. For example, the front side refers to a toe side and the rear side refers to a heel side. In addition, an inner side or an inner foot side refers to a side of the first toe (thumb) of the foot in the foot width direction, and an outer side or an outer foot side refers to a side of the fifth toe of the foot in the foot width direction.

Figure 2:
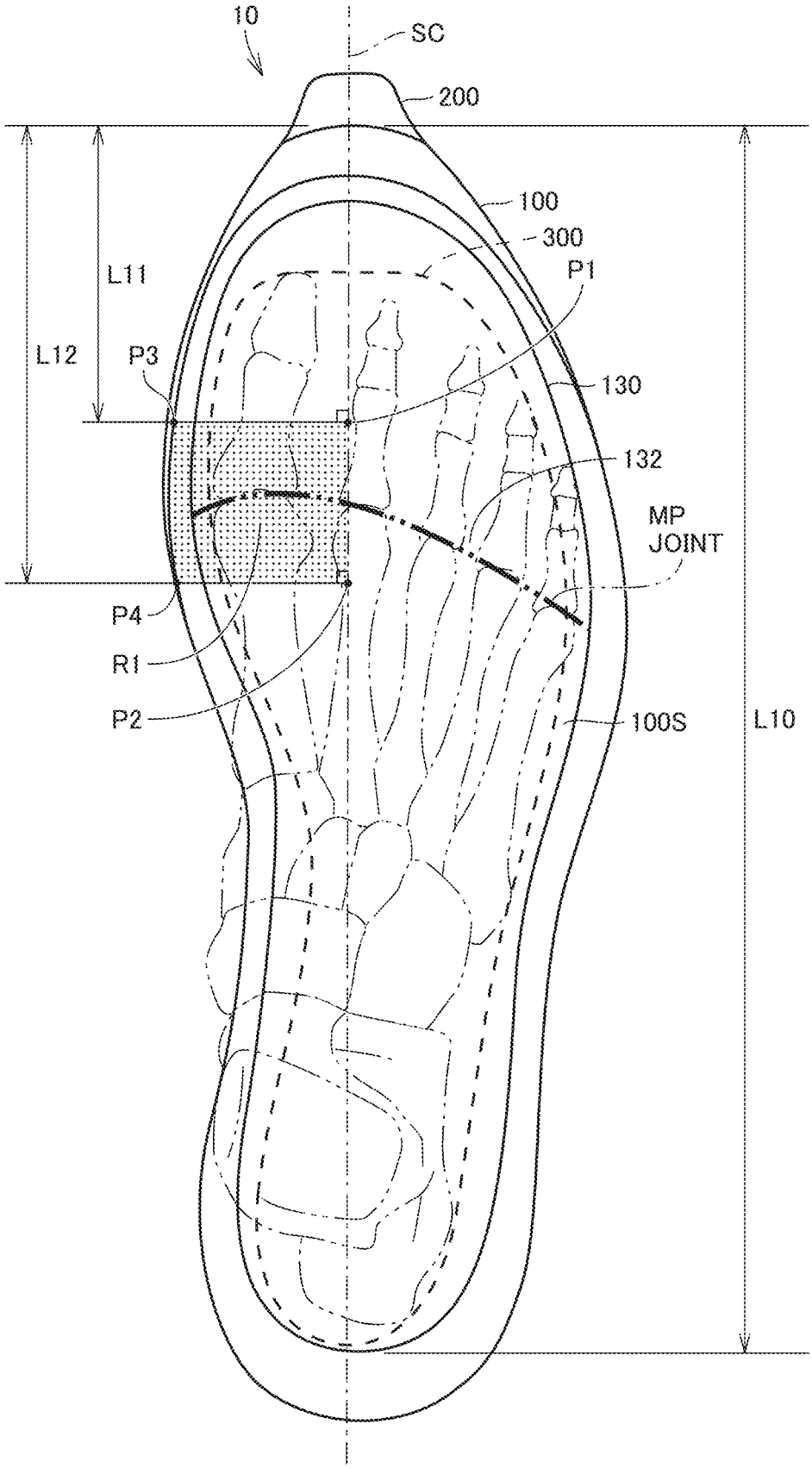
FIG. 2 is a plan view of a sole.

FIG. 1 is a cross-sectional view schematically illustrating a shoe in one embodiment of the present disclosure. FIG. 2 is a plan view of a sole. FIG. 2 shows a sole 10 for the right foot, but the sole 10 is also applicable to the left foot. In this case, the sole for the left foot is in a shape symmetrical with or substantially similar to the sole for the right foot.

The shoe 1 in the present embodiment is suitable, for example, for running, but can also be applicable to other sports shoes or walking shoes, and the use of the shoe 1 is not limited.

As illustrated in FIG. 1, the shoe 1 includes the sole 10 and an upper 20.

The upper 20 is connected to the sole 10. The upper 20 and the sole 10 provide an accommodation space for a wearer's foot. The upper 20 covers an upper surface of the wearer's foot.

The sole 10 constitutes a part of the shoe 1. The sole 10 is connected to a lower portion of the upper 20. The sole 10 is connected to the upper 20 by adhesion, for example. As shown in FIG. 1, the sole 10 includes a midsole 100, an outsole 200, and a plate 300.

The midsole 100 has a cushioning function at the time of landing, a repulsive function at the time of taking off, and the like. The midsole 100 is preferably made of resin, rubber, or the like having an appropriate strength and excellent buffering property. The midsole 100 has an upper connection surface 100S to which the upper is connected. As illustrated in FIG. 1, the midsole 100 includes a first support portion 110, a second support portion 120, and a buffer layer 130.

The first support portion 110 supports a front portion of an MP joint of the wearer's foot. As illustrated in FIG. 1, a surface of a front end portion of the first support portion 110 constitutes a part of the upper connection surface 100S. The first support portion 110 is made of, for example, a resin foam. Examples of the resin constituting the first support portion 110 include a polyamide-based thermoplastic elastomer (TPA, TPAE), a thermoplastic polyurethane (TPU), a polyester-based thermoplastic elastomer (TPEE), and an ethylene-vinyl acetate copolymer (EVA).

The second support portion 120 has a shape extending rearward from the first support portion 110 in the foot length direction (vertical direction in FIG. 2) of the sole 10. The second support portion 120 supports a rear portion of the MP joint of the wearer's foot. The second support portion 120 is made of resin foam, for example. Examples of the resin constituting the second support portion 120 include a polyamide-based thermoplastic elastomer (TPA, TPAE), a thermoplastic polyurethane (TPU), a polyester-based thermoplastic elastomer (TPEE), and an ethylene-vinyl acetate copolymer (EVA).

Here, the foot length direction is a direction parallel to a shoe center SC (see FIG. 2). The shoe center SC is not limited to the center line of the shoe 1, and may be a line that overlaps a straight line passing through the center of the calcaneus of the standard wearer of the shoe 1 and a portion between the first toe and the second toe, and the thickness direction of the sole 10.

The first support portion 110 has an elastic modulus lower than an elastic modulus of the second support portion 120. A ratio of the elastic modulus of the first support portion 110 to the elastic modulus of the second support portion 120 is preferably set to a value greater than or equal to 0.3 times and less than 1 time, and more preferably greater than or equal to 0.3 times and less than 0.75 times. Specifically, the elastic modulus of the first support portion 110 is preferably set to a value greater than or equal to 0.25 MPa and less than or equal to 0.9 MPa, and more preferably greater than or equal to 0.25 MPa and less than or equal to 0.5 MPa.

The elastic modulus of the first support portion 110 is measured, for example, as follows. That is, a test piece having a predetermined shape (for example, a columnar shape) is cut out from the first support portion 110, and measurement is performed by compressing the test piece from both sides in a direction corresponding to the thickness direction of the sole. The elastic modulus of the second support portion 120 is also measured in the same manner. Alternatively, the elastic modulus can also be measured by compressing the test pieces from both sides in a direction in which a load is assumed to be applied at the time of wearing. The elastic modulus is calculated as an initial gradient until the strain reaches 5% in the stress-strain curve obtained by the above measurement.

A boundary portion 115 (see FIG. 1) between the first support portion 110 and the second support portion 120 passes through at least a thenar region R1 (see FIGS. 1 and 2). The thenar region R1 is a region that overlaps the thumb MP joint of the standard wearer's foot of the shoe 1 in the thickness direction. The thenar region R1 is a region surrounded by a first portion P1, a second portion P2, a third portion P3, and a fourth portion P4. In FIGS. 1 and 2, the thenar region R1 is indicated by a dot pattern.

The first portion P1 is located on the shoe center SC, and is located at a position of a first length L11 rearward from a front end portion of the midsole 100 in the foot length direction. The first length L11 is 15% of a total length L10 of the upper connection surface 100S.

The second portion P2 is located on the shoe center SC, and is located at a position of a second length L12 rearward from the front end portion in the foot length direction. The second length L12 is 35% of the total length L10 of the upper connection surface 100S.

The third portion P3 is an intersection of a straight line orthogonal to the shoe center SC and passing through the first portion P1 and an end portion on the inner foot side of the midsole 100 in the foot width direction of the sole 10 (left and right direction in FIG. 2).

The fourth portion P4 is an intersection of a straight line orthogonal to the shoe center SC and passing through the second portion P2 and an end portion on the inner foot side of the midsole 100 in the foot width direction.

An entire region of the boundary portion 115 on the inner side (the thumb side) in the foot width direction in the thickness direction passes through the thenar region R1. In the present embodiment, the boundary portion 115 is provided at a position substantially overlapping all MP joints of the wearer's foot in the thickness direction over the entire region from an upper end to a lower end of the boundary portion 115. The "position substantially overlapping" includes not only a position completely overlapping the MP joint in the thickness direction but also a position shifted from that position by a predetermined length in the foot length direction.

The buffer layer 130 is disposed above the first support portion 110 and the second support portion 120. The buffer layer 130 has a shape extending in the foot length direction across the boundary portion 115 between the first support portion 110 and the second support portion 120. A surface of the buffer layer 130 constitutes the upper connection surface 100S together with the surface of the front end portion of the first support portion 110. The buffer layer 130 is made of resin foam or the like. Examples of the resin constituting the buffer layer 130 include a polyamide-based thermoplastic elastomer (TPA, TPAE), a thermoplastic polyurethane (TPU), a polyester-based thermoplastic elastomer (TPEE), and an ethylene-vinyl acetate copolymer (EVA). An elastic modulus of the buffer layer 130 may be equal to or smaller than the elastic modulus of the second support portion 120. A ratio of the elastic modulus of the buffer layer 130 to the elastic modulus of the second support portion 120 is preferably set to a value greater than or equal to 0.25 times and less than or equal to 1 time, and more preferably greater than or equal to 0.25 times and less than or equal to 0.75 times.

As shown in FIG. 1, the buffer layer 130 has an overlapping portion 132 overlapping the MP joint of the wearer's foot in the thickness direction of the sole 10. A thickness of the overlapping portion 132 in a cross section of the sole 10 in a plane passing through the shoe center SC and parallel to the thickness direction is smaller than the thickness of the boundary portion 115. In the present embodiment, as shown in FIG. 1, the thickness of the buffer layer 130 in the cross section of the sole 10 is smaller than the thicknesses of the first support portion 110 and the second support portion 120 over the entire region of the buffer layer 130 from a front end to a rear end.

The outsole 200 is connected to a lower surface of the midsole 100. The outsole 200 is made of rubber, resin, or the like. The outsole 200 has a shape extending in the foot length direction across the boundary portion 115. The outsole 200 may cover the entire lower surface of the midsole 100, or may cover only a part of the midsole 100 as illustrated in FIG. 1.

The plate 300 is connected to upper surfaces of the first support portion 110 and the second support portion 120. The plate 300 has a shape extending in the foot length direction across the boundary portion 115. As illustrated in FIG. 1, the plate 300 is sandwiched between the first support portion 110 and the second support portion 120, and the buffer layer 130. The plate 300 has a flexural rigidity larger than a flexural rigidity of the first support portion 110 and a flexural rigidity of the second support portion 120. The flexural rigidity of the plate 300 is larger than a flexural rigidity of the buffer layer 130. The plate 300 has a function of increasing the flexural rigidity of the sole 10, a function of uniformly applying a load to portions of the midsole 100 located below the plate 300 (the first support portion 110 and the second support portion 120 in the present embodiment), and the like. The plate 300 is made of a fiber-reinforced resin or a non-fiber-reinforced resin. Examples of fiber used for the fiber-reinforced resin include carbon fiber, glass fiber, aramid fiber, Dyneema® fiber (registered trademark), Zylon® fiber (registered trademark), and boron fiber. In the present embodiment, carbon fibers are used as the fibers. A thickness of the plate 300 is smaller than the thickness of the first support portion 110, the thickness of the second support portion 120, and the thickness of the buffer layer 130.

Figure 3:
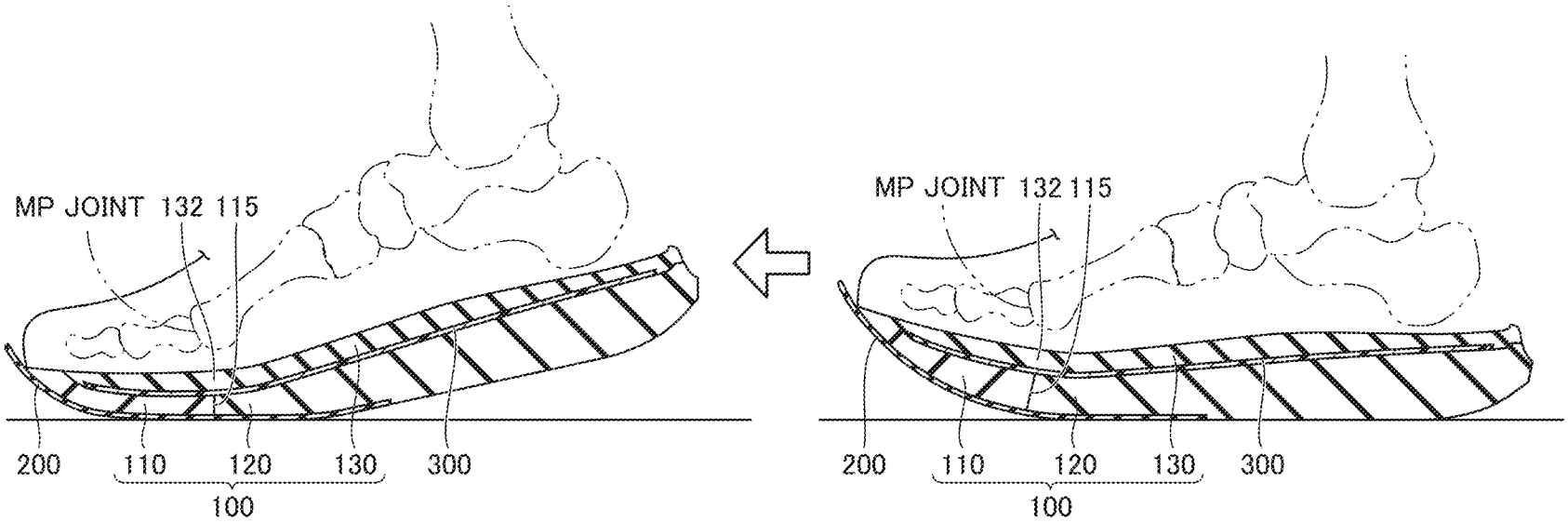
FIG. 3 is a diagram schematically illustrating a process from landing to taking off.

Next, changes in the shapes of the first support portion 110 and the second support portion 120 from the time of landing to the time of taking off will be described with reference to FIG. 3.

From the time of landing to the time before taking off, a large load does not act on the boundary portion 115 between the first support portion 110 and the second support portion 120 from the MP joint of the wearer's foot. On the other hand, at the time of taking off, a large load acts on the boundary portion 115 from the MP joint of the wearer's foot. Therefore, a particularly large compressive load acts on a portion in the vicinity of the boundary portion 115, that is, a front portion of the second support portion 120 and a rear portion of the first support portion 110.

In the present embodiment, since the elastic modulus of the first support portion 110 is lower than the elastic modulus of the second support portion 120, an amount of compressive deformation of the first support portion 110 is larger than an amount of compressive deformation of the second support portion 120. That is, at the time of taking off, an amount of sinking in a portion of the wearer's foot in front of the MP joint becomes relatively large.

As a result, a decrease in an angle of the ankle joint of the wearer at the time of taking off is suppressed, and thus a change in the angle of the ankle joint from the time of landing to the time of taking off is reduced. Therefore, a load on the foot during traveling or the like is reduced.

In particular, at the time of taking off, the load acting on the first support portion 110 and the second support portion 120 located below the plate 300 is made uniform, so that the deformation range of the first support portion 110 and the second support portion 120 becomes large as compared with the case where the plate 300 is not provided. Even when a large load acts on the sole 10, the bottom touch feeling felt by the wearer is reduced. The plate 300 improves the stability of the foot portion at the time of landing and taking off, and since the plate 300 is across the boundary portion 115, the wearer is less likely to feel a local change in hardness around the boundary portion 115.

Furthermore, in the above embodiment, the thickness of the buffer layer 130 in the cross section of the sole 10 is smaller than the thicknesses of the first support portion 110 and the second support portion 120 over the entire region of the buffer layer 130 from the front end to the rear end. As a result, the amount of deformation of the first support portion 110 can be increased, and an effect of reducing the change in angle of the ankle joint from the time of landing to the time of taking off can be greatly received.

Hereinafter, modified examples of the above embodiment will be described with reference to FIGS. 4 to 12.

First Modified Example

Figure 4:
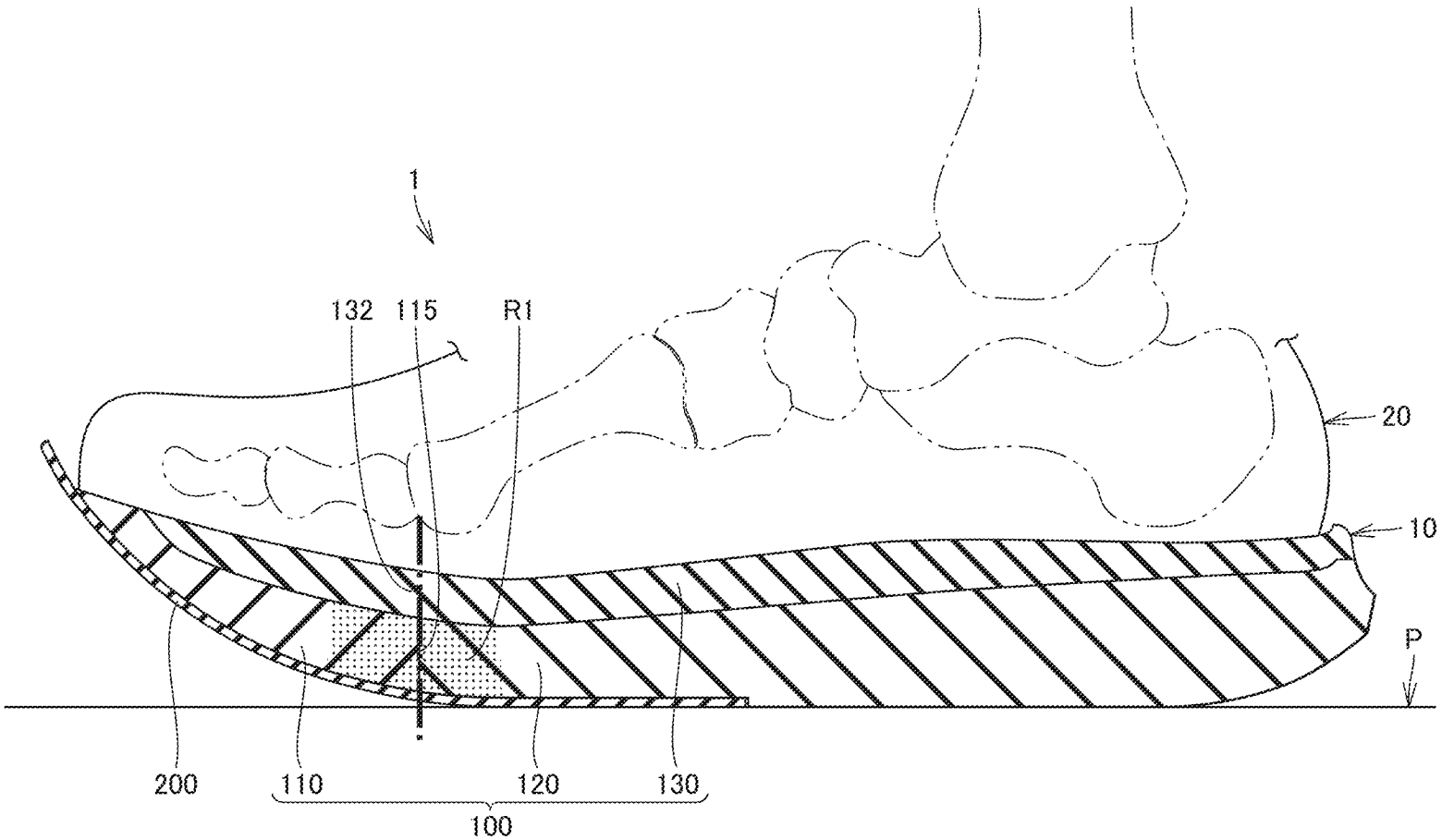
FIG. 4 is a cross-sectional view schematically illustrating a modified example of the sole.

As shown in FIG. 4, the plate 300 may be omitted. Without the plate 300, even a wearer whose load applied to the sole 10 is relatively small can easily feel the effect that the change in angle of the ankle joint between the time of landing and the time of taking off decreases. In addition, since the plate 300 is not provided, a lightweight property of the sole 10 is improved.

Second Modified Example

Figure 5:
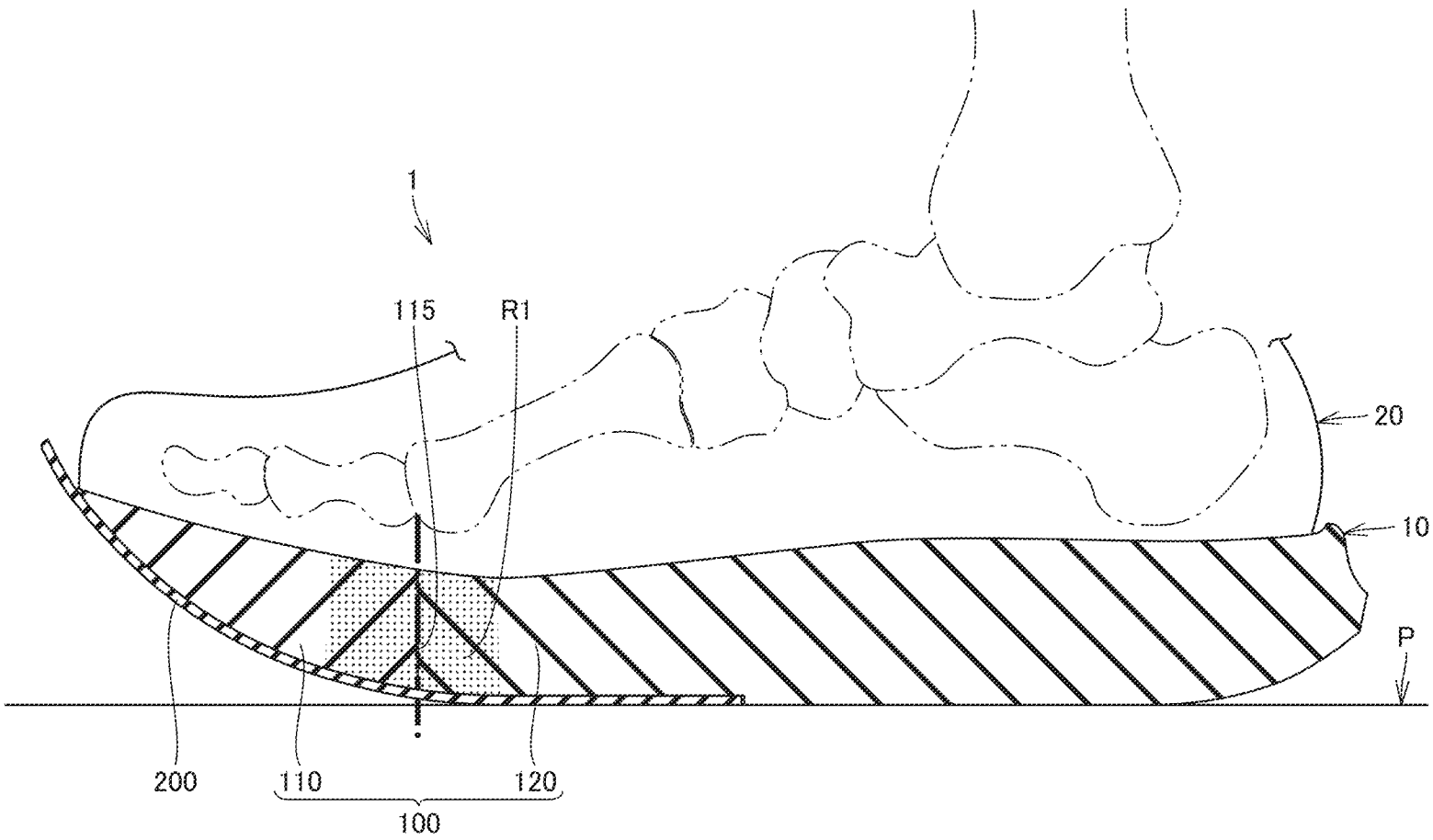
FIG. 5 is a cross-sectional view schematically illustrating a modified example of the sole.

As illustrated in FIG. 5, the plate 300 and the buffer layer 130 may be omitted. Without the plate 300 and the buffer layer 130, even a wearer whose load applied to the sole 10 is relatively small can easily feel the effect that the change in angle of the ankle joint between the time of landing and the time of taking off decreases.

Third Modified Example

Figure 6:
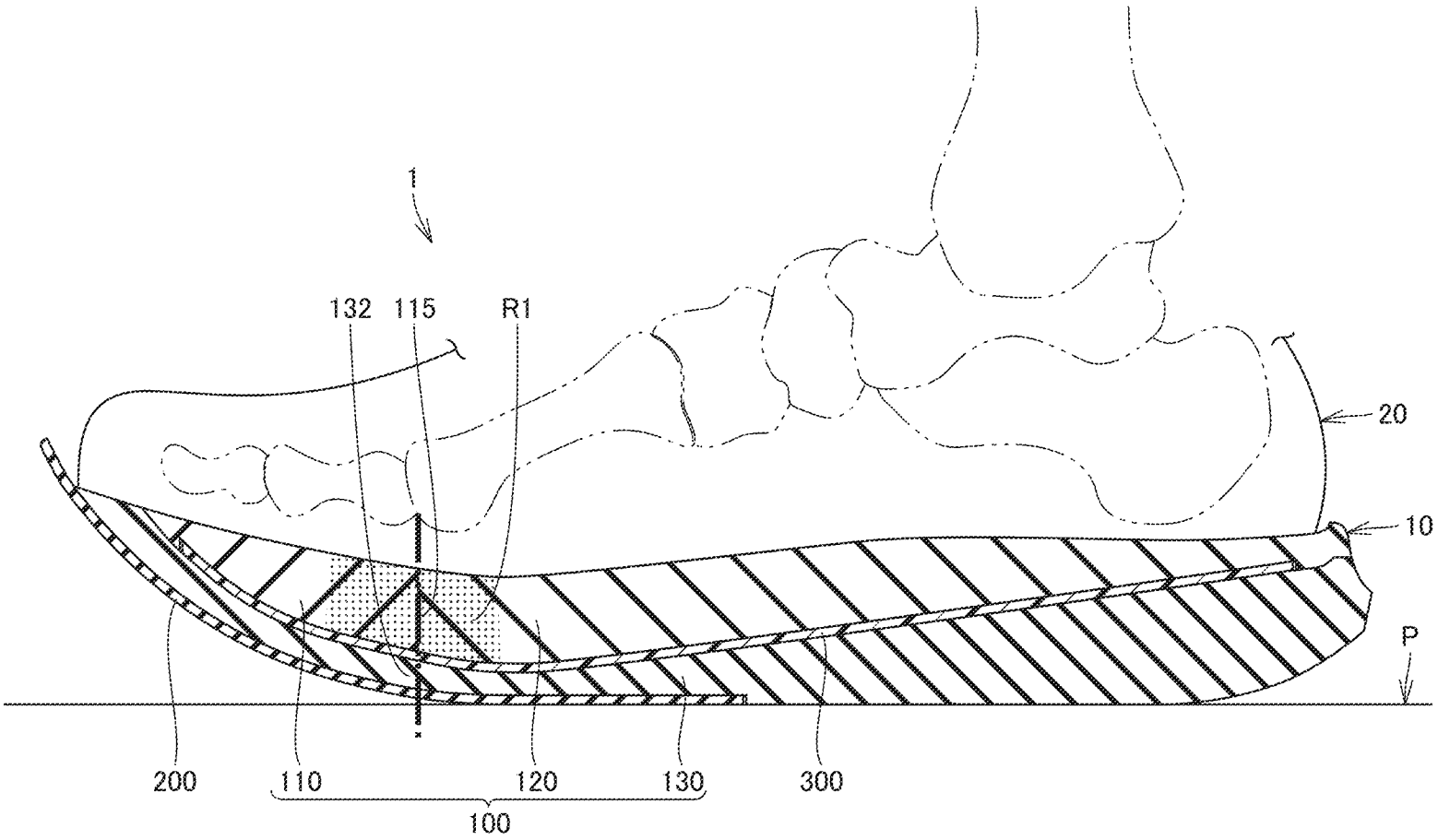
FIG. 6 is a cross-sectional view schematically illustrating a modified example of the sole.

As illustrated in FIG. 6, the buffer layer 130 may be disposed below the first support portion 110 and the second support portion 120. In this case, the plate 300 is disposed so as to be in contact with lower surfaces of the first support portion 110 and the second support portion 120. As a result, a connection surface between the buffer layer 130 and the plate 300 can be inclined from a forefoot portion to a heel portion, and the fall of the heel portion from the midfoot at the time of taking off is suppressed. In this example, the plate 300 may be omitted.

Fourth Modified Example

Figure 7:
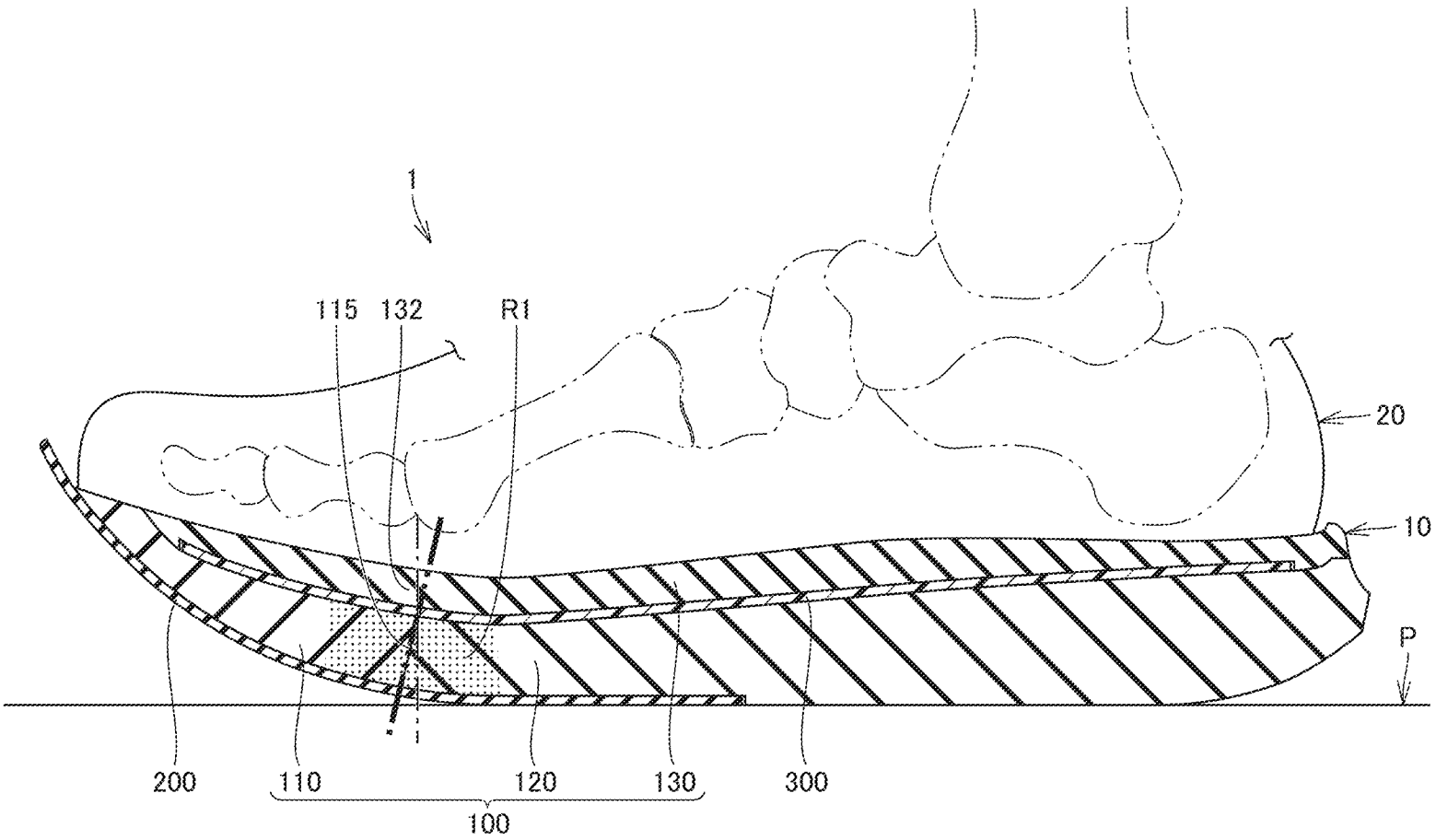
FIG. 7 is a cross-sectional view schematically illustrating a modified example of a boundary portion.

As shown in FIG. 7, the boundary portion 115 may have a shape gradually inclined forward in the foot length direction as proceeding downward in the thickness direction of the sole 10. In this example, the upper end of the boundary portion 115 is provided at the same position as the upper end of the boundary portion 115 in the above embodiment. In FIG. 7, the boundary portion 115 in the above embodiment is indicated by an alternate long and short dash line.

In this aspect, when entire the sole 10 is inclined forward at the time of taking off, the boundary portion 115 comes close to a direction perpendicular to a landing surface, and the amount of compressive deformation of the front portion of the second support portion 120 at the time of taking off increases. Therefore, a repulsive force from the second support portion 120 is largely secured. This is particularly noticeable for a wearer with a large kicking angle.

Fifth Modified Example

Figure 8:
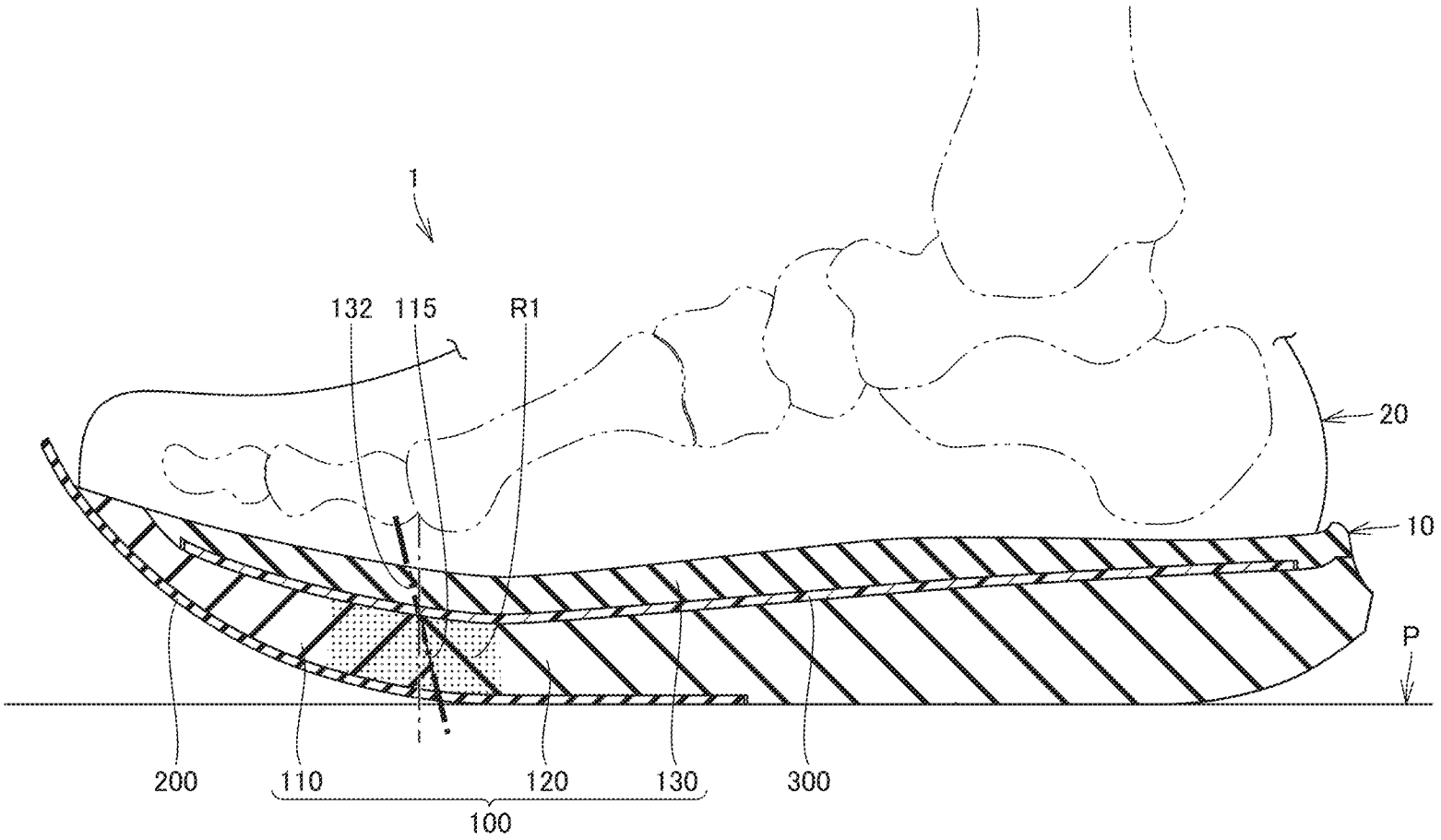
FIG. 8 is a cross-sectional view schematically illustrating a modified example of the boundary portion.

As shown in FIG. 8, the boundary portion 115 may have a shape gradually inclined rearward in the foot length direction as proceeding downward in the thickness direction of the sole 10. Also in this example, the upper end of the boundary portion 115 is provided at the same position as the upper end of the boundary portion 115 in the above embodiment. In FIG. 8, the boundary portion 115 in the above embodiment is indicated by an alternate long and short dash line.

In this aspect, since the boundary portion 115 comes close to a landing point in the vicinity of the landing surface of the sole 10, an impact buffering property at the time of landing is increased.

Sixth Modified Example

Figure 9:
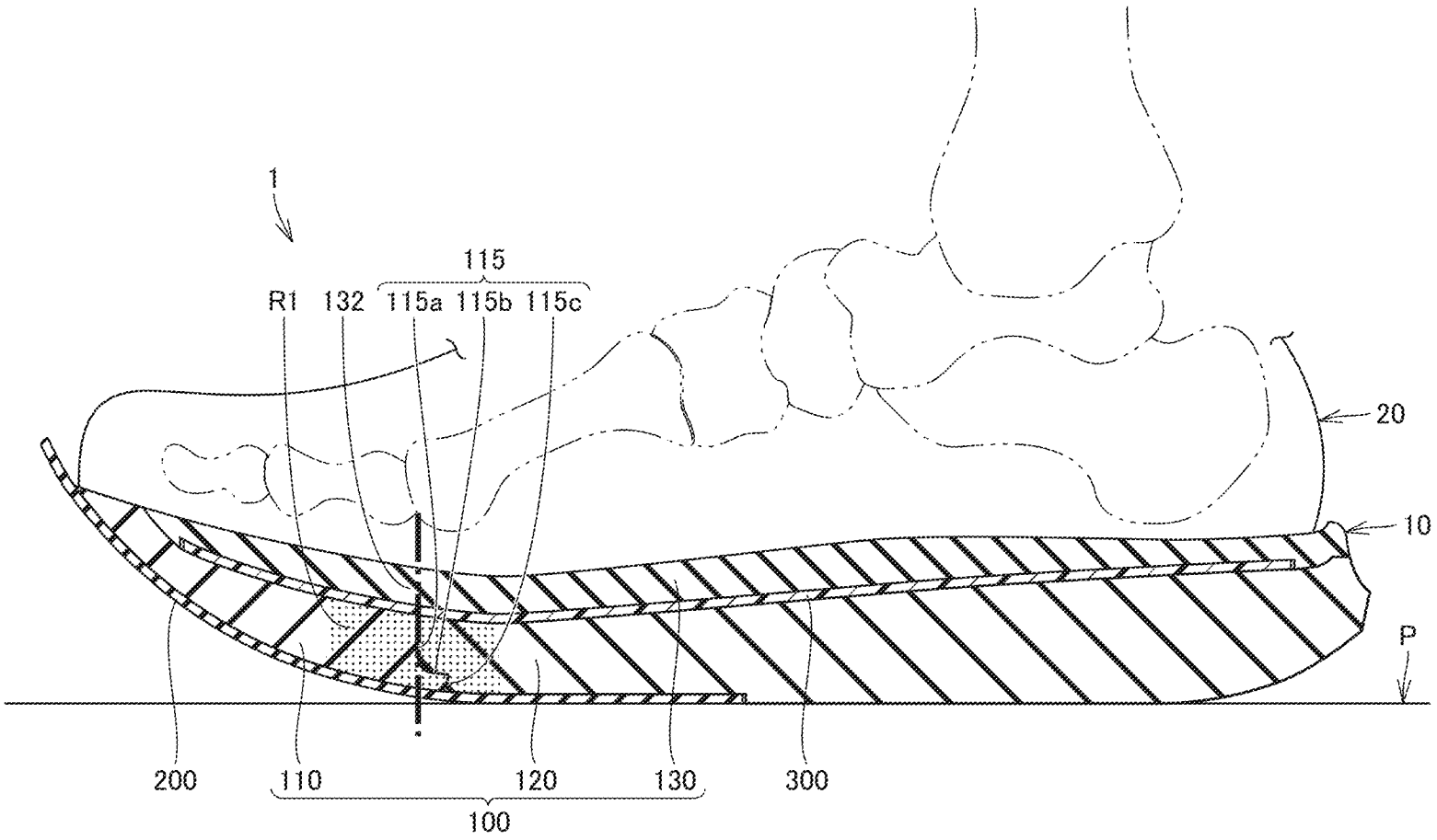
FIG. 9 is a cross-sectional view schematically illustrating a modified example of the boundary portion.

As illustrated in FIG. 9, the boundary portion 115 may have a shape including at least one inflection point or vertex in a cross section in a plane parallel to a plane including the foot length direction and a thickness direction of the sole. In this example, the boundary portion 115 has an upper side surface 115*a*, an intermediate surface 115*b*, and a lower side surface 115*c*.

The upper side surface 115*a* includes an upper end of the boundary portion 115 and is provided in parallel with the thickness direction.

The intermediate surface 115*b* intersects with the upper side surface 115*a*. The intermediate surface 115*b* may be orthogonal to the upper side surface 115*a*. The intermediate surface 115*b* extends rearward from the upper side surface 115*a*. A boundary between the intermediate surface 115*b* and the upper side surface 115*a* is constituted by a curved surface.

The lower side surface 115*c* intersects with the intermediate surface 115*b*. The lower side surface 115*c* extends downward from a rear end of the intermediate surface 115*b*. The lower side surface 115*c* has a shape gradually inclined forward in the foot length direction as proceeding downward in the thickness direction of the sole 10. A boundary between the lower side surface 115*c* and the intermediate surface 115*b* is constituted by a corner portion. The lower side surface 115*c* may be provided in parallel with the thickness direction.

In this aspect, since an area of the boundary portion 115 is secured, the first support portion 110 and the second support portion 120 are prevented from being separated from each other.

Seventh Modified Example

Figure 10:
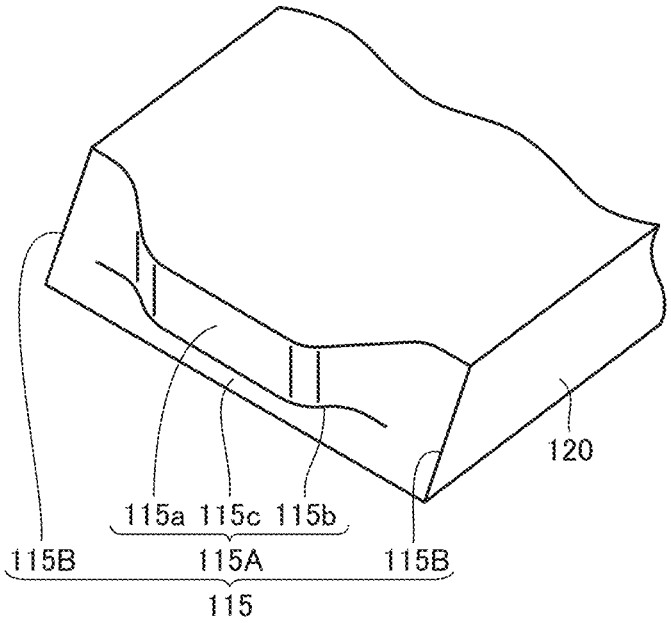
FIG. 10 is a perspective view schematically illustrating the boundary portion illustrated in FIG. 9.

As illustrated in FIG. 10, the boundary portion 115 may include a central boundary portion 115A and an end boundary portion 115B.

The central boundary portion 115A is provided at a center in the foot width direction. The central boundary portion 115A has the same shape as that in the sixth modified example.

The end boundary portion 115B is provided at an end portion in the foot width direction. As in the fourth modified example, the end boundary portion 115B has a shape gradually inclined forward in the foot length direction as proceeding downward in the thickness direction of the sole 10. As in the fifth modified example, the end boundary portion 115B may have a shape gradually inclined rearward in the foot length direction as proceeding downward in the thickness direction of the sole 10.

In this aspect, bonding between the first support portion 110 and the second support portion 120 becomes stronger, and a bonding characteristic at the time of manufacturing is improved.

Eighth Modified Example

Figure 11:
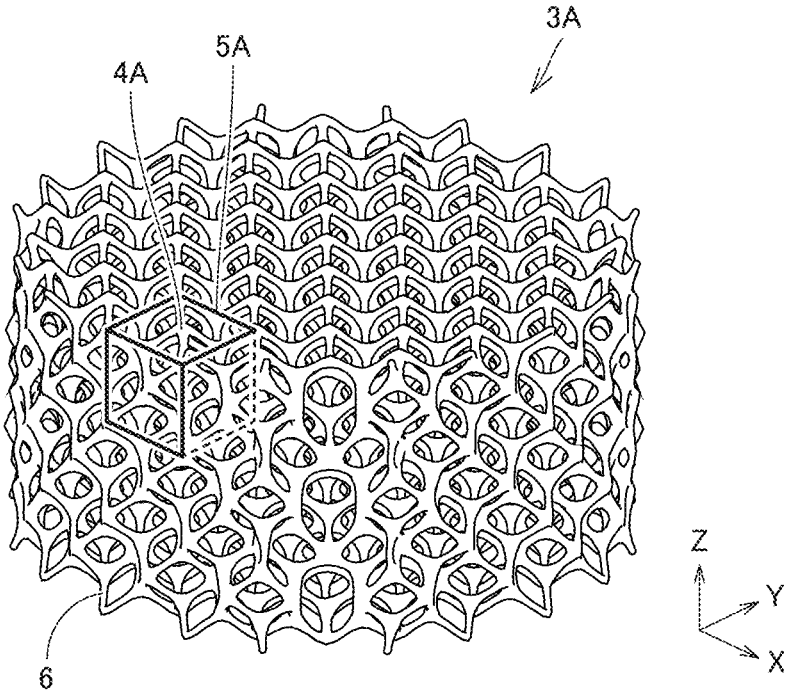
FIG. 11 is a schematic diagram for illustration of a modified example of a first support portion.
Figure 12:
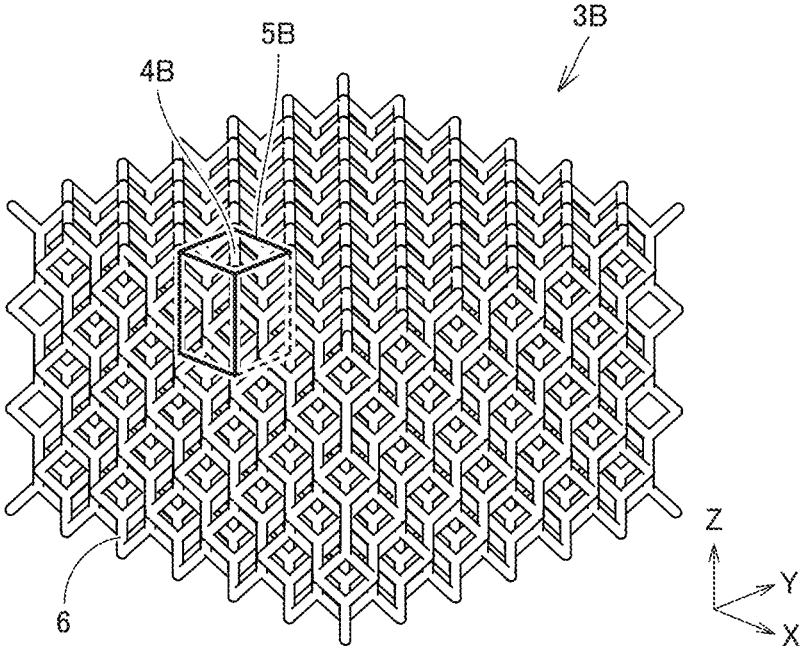
FIG. 12 is a schematic diagram for illustration of a modified example of the first support portion.

The first support portion 110 may include a three-dimensional mesh structure 3A or 3B illustrated in FIG. 11 or FIG. 12. This three-dimensional mesh structure is manufactured by, for example, three-dimensional additive manufacturing of a stereolithography method. FIG. 11 is a schematic diagram for illustration of a three-dimensional lattice structure of the first support portion 110. FIG. 12 is a schematic diagram for illustration of a three-dimensional lattice structure according to the structure shown in FIG. 11.

The three-dimensional mesh structure 3A shown in FIG. 11 has a plurality of unit structures 4A disposed so as to be repeatedly arranged. Each unit structure 4A has a three-dimensional lattice structure. The plurality of unit structures 4A are repeatedly arrayed regularly and continuously along each of a width direction (X direction in FIG. 11), a depth direction (Y direction in FIG. 11), and a height direction (Z direction in FIG. 11). FIG. 11 illustrates only some unit structures 4A adjacent to each other in the width direction, the depth direction, and the height direction.

The unit structure 4A having a three-dimensional lattice structure has a three-dimensional shape in which a plurality of columnar portions 6 extending along a predetermined direction are connected to each other. The plurality of columnar portions 6 are configured such that adjacent columnar portions 6 intersect with the extending direction thereof, and thus providing a three-dimensional lattice structure. The unit structure 4A illustrated in FIG. 11 is called a fluorite type lattice. Note that a unit space 5A occupied by the unit structure 4A has a polyhedral shape, and the unit space 5A has a hexahedral shape in the unit structure 4A illustrated in FIG. 11.

In the three-dimensional mesh structure 3A shown in FIG. 11, each of the plurality of columnar portions 6 is configured to have a substantially columnar outer shape. Therefore, a cross-sectional shape orthogonal to the extending direction of each of the plurality of columnar portions 6 is substantially circular. Further, in the three-dimensional mesh structure 3A illustrated in FIG. 11, a thickness of each of the plurality of columnar portions 6 continuously changes along the extending direction thereof. Specifically, each columnar portion 6 has a shape in which the thickness is large at a connection portion with another columnar portion 6 adjacent to each columnar portion 6, and the thickness decreases as a distance from the connection portion increases. According to this configuration, it is possible to enhance durability while maintaining flexibility.

A three-dimensional mesh structure 3B illustrated in FIG. 12 has a three-dimensional structure having a configuration according to the structure illustrated in FIG. 11, and a unit structure 4B is a fluorite type lattice, and a unit space 5B occupied by the unit structure 4B has a hexahedron shape. However, in the three-dimensional mesh structure 3B, unlike the structure shown in FIG. 11, a thickness of each of the plurality of columnar portions 6 is uniformly configured along the extending direction thereof.

Note that, as the unit structures 4A and 4B, various structures other than the structures shown in FIGS. 11 and 12 can be adopted, and such as a rectangular parallelepiped lattice, a diamond lattice, an octahedral lattice, a double pyramid lattice, or a lattice to which various supports are added can be applied, for example.

In the three-dimensional mesh structure as described above, since a space factor can be easily adjusted as compared with a resin foam (foam material), a difference between the elastic modulus of the first support portion 110 and the elastic modulus of the second support portion 120 can be easily designed.

The three-dimensional mesh structures 3A and 3B can also be made of a polymer composition. In this case, examples of the polymer to be contained in the polymer composition include olefin-based polymers such as olefin-based elastomers and olefin-based resins. Examples of the olefin-based polymer include polyolefins such as polyethylene (for example, linear low density polyethylene (LLDPE), high density polyethylene (HDPE), and the like), polypropylene, an ethylene-propylene copolymer, a propylene-1 hexene copolymer, a propylene-4 methyl-1 pentene copolymer, a propylene-1 butene copolymer, an ethylene-1 hexene copolymer, an ethylene-4 methyl-pentene copolymer, an ethylene-1 butene copolymer, a 1-butene-1 hexene copolymer, a 1-butene-4 methyl-pentene, an ethylene-methacrylic acid copolymer, an ethylene-methyl methacrylate copolymer, an ethylene-ethyl methacrylate copolymer, an ethylene-butyl methacrylate copolymer, an ethylene-methyl acrylate copolymer, an ethylene-ethyl acrylate copolymer, an ethylene-butyl acrylate copolymer, a propylene-methacrylic acid copolymer, a propylene-methyl methacrylate copolymer, and a propylene-ethyl methacrylate copolymer, a propylene-butyl methacrylate copolymer, a propylene-methyl acrylate copolymer, a propylene-ethyl acrylate copolymer, a propylene-butyl acrylate copolymer, an ethylene-vinyl acetate copolymer (EVA), and a propylene-vinyl acetate copolymer.

The polymer may be, for example, an amide-based polymer such as an amide-based elastomer or an amide-based resin. Examples of the amide-based polymer include polyamide 6, polyamide 11, polyamide 12, polyamide 66, and polyamide 610.

The polymer may be, for example, an ester-based polymer such as an ester-based elastomer or an ester-based resin. Examples of the ester-based polymer include polyethylene terephthalate and polybutylene terephthalate.

The polymer may be, for example, a urethane-based polymer such as a urethane-based elastomer or a urethane-based resin. Examples of the urethane-based polymer include polyester-based polyurethanes and polyether-based polyurethanes, and in particular, urethane acrylates can be suitably used.

The polymer may be, for example, a styrene-based polymer such as a styrene-based elastomer or a styrene-based resin. Examples of the styrene-based elastomer include a styrene-ethylene-butylene copolymer (SEB), a styrene-butadiene-styrene copolymer (SBS), a hydrogenated product of SBS (styrene-ethylene-butylene-styrene copolymer (SEBS)), a styrene-isoprene-styrene copolymer (SIS), a hydrogenated product of SIS (styrene-ethylene-propylene-styrene copolymer (SEPS)), a styrene-isobutylene-styrene copolymer (SIBS), styrene-butadiene-styrene-butadiene (SBSB), and styrene-butadiene-styrene-butadiene-styrene (SBSBS). Examples of the styrene-based resin include polystyrene, acrylonitrile styrene resin (AS), and acrylonitrile butadiene styrene resin (ABS).

In addition, the polymer may be, for example, an acrylic polymer such as polymethyl methacrylate, a urethane-based acrylic polymer, a polyester-based acrylic polymer, a polyether-based acrylic polymer, a polycarbonate-based acrylic polymer, an epoxy-based acrylic polymer, a conjugated diene polymerization-based acrylic polymer and hydrogenated products thereof, a urethane-based methacrylic polymer, a polyester-based methacrylic polymer, a polyether-based methacrylic polymer, a polycarbonate-based methacrylic polymer, an epoxy-based methacrylic polymer, a conjugated diene polymerization-based methacrylic polymer and hydrogenated products thereof, a polyvinyl chloride-based resin, a silicone-based elastomer, a butadiene rubber (BR), an isoprene rubber (IR), a chloroprene (CR), a natural rubber (NR), a styrene butadiene rubber (SBR), an acrylonitrile butadiene rubber (NBR), a butyl rubber (IIR), and the like.

It is understood by those skilled in the art that the exemplary embodiment described above is a specific example of the following aspects.

[Aspect 1]

A sole that constitutes a part of a shoe, the sole including:

a midsole including an upper connection surface to which an upper is connected and that is configured to support a wearer's foot, wherein the midsole includes:

a first support portion that is configured to support a front portion of an MP joint of the wearer's foot; and a second support portion that is configured to support a rear portion of the MP joint of the wearer's foot, the second support portion having a shape extending rearward from the first support portion in a foot length direction of the sole, the first support portion has an elastic modulus lower than an elastic modulus of the second support portion, the midsole includes a thenar region surrounded by a first portion, a second portion, a third portion, and a fourth portion, the first portion being located on a shoe center and located at a position rearward from a front end portion of the midsole in the foot length direction by a length of 15% of a total length of the upper connection surface; the second portion being located on the shoe center and located at a position rearward from the front end portion in the foot length direction by a length of 35% of a total length of the upper connection surface; the third portion corresponding to an intersection of a straight line that is orthogonal to the shoe center and passes through the first portion and an end portion on an inner foot side of the midsole in a foot width direction of the sole; and the fourth portion corresponding to an intersection of a straight line that is orthogonal to the shoe center and passes through the second portion and an end portion on an inner foot side of the midsole in the foot width direction, and a boundary portion between the first support portion and the second support portion passes through the thenar region.

Generally, at the time of taking off in a running motion or the like, a large load acts on the sole from a front portion of the MP joint of the wearer's foot. In this sole, the elastic modulus of the first support portion is lower than the elastic modulus of the second support portion, and the boundary portion between the first support portion and the second support portion passes through the thenar region that is the region overlapping the thenar eminence of the standard wearer's foot, so that the first support portion is compressed and deformed relatively largely at the time of taking off. As a result, a decrease in the angle of the ankle joint of the wearer at the time of taking off is suppressed, and thus a change in the angle of the ankle joint from the time of landing to the time of taking off is reduced. Therefore, a load on the foot during traveling or the like is reduced.

[Aspect 2]

The sole according to aspect 1, wherein the boundary portion has a shape gradually inclined forward in the foot length direction as proceeding downward in a thickness direction of the sole.

In this aspect, when the entire sole is inclined forward at the time of taking off, the boundary portion comes close to a direction perpendicular to a landing surface, and the amount of compressive deformation of the front portion of the second support portion at the time of taking off increases. Therefore, a repulsive force from the second support portion is largely secured. This is particularly noticeable for a wearer with a large kicking angle.

[Aspect 3]

The sole according to aspect 1, wherein the boundary portion has a shape gradually inclined rearward in the foot length direction as proceeding downward in a thickness direction of the sole.

In this aspect, since the boundary portion comes close to the landing point in the vicinity of the landing surface of the sole, an impact buffering property at the time of landing is increased.

[Aspect 4]

The sole according to aspect 1, wherein the boundary portion has a shape including at least one inflection point or vertex in a cross section in a plane parallel to a plane including the foot length direction and a thickness direction of the sole.

In this aspect, since an area of the boundary portion is secured, the first support portion and the second support portion are prevented from being separated from each other.

[Aspect 5]

The sole according to aspect 1, wherein the boundary portion includes:

a central boundary portion provided at a center in the foot width direction; and an end boundary portion provided at an end portion in the foot width direction, the central boundary portion has a shape including at least one inflection point or vertex in a cross section in a plane parallel to a plane including the foot length direction and a thickness direction of the sole, and the end boundary portion has a shape gradually inclined forward in the foot length direction as proceeding downward in the thickness direction of the sole.

In this aspect, the first support portion and the second support portion are prevented from being separated from each other at the central boundary portion, and a repulsive force from the front portion of the second support layer at the time of taking off increases at the end boundary portion.

[Aspect 6]

The sole according to any one of aspects 1 to 5, further including:

a buffer layer disposed above or below the first support portion and the second support portion, wherein the buffer layer has a shape extending along the foot length direction across the boundary portion.

In this aspect, since the buffering property at the time of landing is improved, and since the buffer layer is disposed across the boundary portion, the wearer is less likely to feel a local change in hardness around the boundary portion.

[Aspect 7]

The sole according to aspect 6, wherein the buffer layer includes an overlapping portion that overlaps the boundary portion in a thickness direction of the sole, and a thickness of the overlapping portion is smaller than a thickness of the boundary portion in a cross section of the sole in a plane that passes through the shoe center and that is parallel to the thickness direction.

In this aspect, the buffering effect immediately below the foot portion can be enhanced, the amount of deformation of the first support portion can be increased, and the effect of reducing the change in the angle of the ankle joint from the time of landing to the time of taking off can be enhanced.

[Aspect 8]

The sole according to any one of aspects 1 to 7, further including:

a plate having a flexural rigidity greater than a flexural rigidity of the first support portion and a flexural rigidity of the second support portion, wherein the plate is disposed so as to be in contact with upper surfaces or lower surfaces of the first support portion and the second support portion, and has a shape extending along the foot length direction across the boundary portion.

In this aspect, the plate improves the stability of the foot portion at the time of landing and taking off, and since the plate is across the boundary portion, the wearer is less likely to feel a local change in hardness around the boundary portion.

[Aspect 9]

The sole according to aspect 8, wherein the plate is disposed so as to be in contact with the upper surfaces of the first support portion and the second support portion.

In this aspect, particularly at the time of taking off, the loads acting on the first support portion and the second support portion are made uniform.

[Aspect 10]

The sole according to any one of aspects 1 to 9, wherein the first support portion includes a three-dimensional mesh structure, and the second support portion includes resin foam.

Since the three-dimensional mesh structure easily adjust the space factor as compared with a resin foam, in this aspect, a difference between the elastic modulus of the first support portion and the elastic modulus of the second support portion can be easily designed.

[Aspect 11]

A shoe including:

the sole according to any one of aspects 1 to 10; and the upper connected to the sole and providing, together with the sole, an accommodation space for the wearer's foot.

Although the present disclosure has been described and illustrated, it is understood that the embodiment disclosed herein is by way of illustration and example only and is not to be taken by way of limitation. The scope of the present invention is interpreted by the terms of the appended claims, and it is intended that meanings equivalent to the claims and all modifications within the scope are included.

What is claimed is:

1. A sole that constitutes a part of a shoe, the sole comprising a midsole including an upper connection surface to which an upper is connected and that is configured to support a wearer's foot, wherein the midsole includes:

a first support portion that is configured to support a front portion of an MP joint of the wearer's foot;

a second support portion that is configured to support a rear portion of the MP joint of the wearer's foot, the second support portion having a shape extending rearward from the first support portion in a foot length direction of the sole, the first support portion having an elastic modulus lower than an elastic modulus of the second support portion;

a thenar region surrounded by a first portion, a second portion, a third portion, and a fourth portion, the first portion being located on a shoe center and located at a position rearward from a front end portion of the midsole in the foot length direction by a length of 15% of a total length of the upper connection surface; the second portion being located on the shoe center and located at a position rearward from the front end portion in the foot length direction by a length of 35% of a total length of the upper connection surface; the third portion corresponding to an intersection of a straight line that is orthogonal to the shoe center and passes through the first portion and an end portion on an inner foot side of the midsole in a foot width direction of the sole; and the fourth portion corresponding to an intersection of a straight line that is orthogonal to the shoe center and passes through the second portion and an end portion on an inner foot side of the midsole in the foot width direction;

a boundary portion between the first support portion and the second support portion passes through the thenar region; and a buffer layer disposed above or below the first support portion and the second support portion, wherein the buffer layer has a shape extending along the foot length direction across the boundary portion.

2. The sole according to claim 1, wherein the boundary portion has a shape gradually inclined forward in the foot length direction as proceeding downward in a thickness direction of the sole.

3. The sole according to claim 1, wherein the boundary portion has a shape gradually inclined rearward in the foot length direction as proceeding downward in a thickness direction of the sole.

4. The sole according to claim 1, wherein the boundary portion has a shape including at least one inflection point or vertex in a cross section in a plane parallel to a plane including the foot length direction and a thickness direction of the sole.

5. The sole according to claim 1, wherein the boundary portion includes:

a central boundary portion provided at a center in the foot width direction; and an end boundary portion provided at an end portion in the foot width direction;

wherein the central boundary portion has a shape including at least one inflection point or vertex in a cross section in a plane parallel to a plane including the foot length direction and a thickness direction of the sole; and wherein the end boundary portion has a shape gradually inclined forward in the foot length direction as proceeding downward in the thickness direction of the sole.

6. The sole according to claim 1, wherein the buffer layer includes an overlapping portion that overlaps the boundary portion in a thickness direction of the sole; and wherein a thickness of the overlapping portion is smaller than a thickness of the boundary portion in a cross section of the sole in a plane that passes through the shoe center and that is parallel to the thickness direction.

7. The sole according to claim 1, further comprising a plate having a flexural rigidity greater than a flexural rigidity of the first support portion and greater than a flexural rigidity of the second support portion, wherein the plate is disposed so as to be in contact with upper surfaces or lower surfaces of the first support portion and the second support portion, and has a shape extending along the foot length direction across the boundary portion.

8. The sole according to claim 7, wherein the plate is disposed so as to be in contact with the upper surfaces of the first support portion and the second support portion.

9. The sole according to claim 1:

wherein the first support portion includes a three-dimensional mesh structure; and wherein the second support portion includes resin foam.

10. A shoe comprising:

the sole according to claim 1; and the upper connected to the sole and providing, together with the sole, an accommodation space for the wearer's foot.

11. The sole according to claim 1, wherein the first support portion has a greater thickness than the buffer layer at the first portion of the thenar region in a plane that passes through the shoe center and that is parallel to a thickness direction of the sole.

12. The sole according to claim 1, wherein the buffer layer is positioned above the first support portion and the second support portion.

13. The sole according to claim 1, wherein the buffer layer is positioned below the first support portion and the second support portion.

14. The sole according to claim 13, further comprising a plate having a flexural rigidity greater than a flexural rigidity of the first support portion and greater than a flexural rigidity of the second support portion, wherein the plate is positioned above the buffer layer and below the first support portion and the second support portion.

15. The sole according to claim 7, wherein the plate is disposed so as to be in contact with the lower surfaces of the first support portion and the second support portion.

16. The sole according to claim 1, wherein the boundary portion has a shape inclined forward in the foot length direction as proceeding downward in a thickness direction of the sole from an upper end of the boundary portion to a lower end of the boundary portion.

17. The sole according to claim 1, wherein the boundary portion has a shape inclined rearward in the foot length direction as proceeding downward in a thickness direction of the sole from an upper end of the boundary portion to a lower end of the boundary portion.

18. The sole according to claim 1, wherein the boundary portion includes:

a central boundary portion provided at a center in the foot width direction; and an end boundary portion provided at an end portion in the foot width direction;

wherein the central boundary portion has a shape including at least one inflection point or vertex in a cross section in a plane parallel to a plane including the foot length direction and a thickness direction of the sole; and wherein the end boundary portion has a shape gradually inclined forward in the foot length direction as proceeding downward in the thickness direction of the sole from an upper end of the end boundary portion to a lower end of the end boundary portion.

19. The sole according to claim 1, wherein the second support portion extends to a rear end of the sole.

* * * * *